US011470939B2

(12) United States Patent
Esteve

(10) Patent No.: US 11,470,939 B2
(45) Date of Patent: Oct. 18, 2022

(54) HAIR APPLICATOR

(71) Applicant: Emphasys Importadora Exportadora e Distribuidora Ltda., Porto Feliz Sp (BR)

(72) Inventor: Victor Esteve, Itu (BR)

(73) Assignee: EMPHASYS IMPORTADORA EXPORTADORA E DISTRIBUIDORA LTDA., Porto Feliz SP (BR)

( * ) Notice: Subject to any disclaimer, the term of this patent is extended or adjusted under 35 U.S.C. 154(b) by 688 days.

(21) Appl. No.: 16/470,797

(22) PCT Filed: Jan. 23, 2017

(86) PCT No.: PCT/IB2017/000029
§ 371 (c)(1),
(2) Date: Jun. 18, 2019

(87) PCT Pub. No.: WO2018/134632
PCT Pub. Date: Jul. 26, 2018

(65) Prior Publication Data

US 2019/0374001 A1 Dec. 12, 2019

(51) Int. Cl.
*A45D 24/22* (2006.01)
*A45D 34/04* (2006.01)
*A45D 19/00* (2006.01)

(52) U.S. Cl.
CPC ..... *A45D 24/22* (2013.01); *A45D 34/04* (2013.01); *A45D 19/0066* (2021.01)

(58) Field of Classification Search
CPC .... A45D 19/02; A45D 19/022; A45D 19/026; A45D 19/028; A45D 19/0066;
(Continued)

(56) References Cited

U.S. PATENT DOCUMENTS 1,704,959 A * 3/1929 Butler ..... A45D 24/24 132/115
2,645,231 A * 7/1953 Decker ..... A45D 24/24 132/115

(Continued)

FOREIGN PATENT DOCUMENTS

WO 2009071485 A1 6/2009

OTHER PUBLICATIONS

International Search Report and Written Opinion issued in International Application No. PCT/IB2017/000029 dated May 17, 2017, 8 pages.

(Continued)

*Primary Examiner* — Jacqueline T Johanas
*Assistant Examiner* — Lina Faraj
(74) *Attorney, Agent, or Firm* — Carter, DeLuca & Farrell LLP

(57) ABSTRACT

A hair applicator for the application of medical liquids, hair dye, hair-care products and/or skin care products for the scalp includes a container defining a volume for storing the liquids, in particular a bottle. The container has a neck, a cap configured to close the container at the neck and having at least one application tip with at least one application nozzle for the application of the liquids. The cap is hollow and comprises a valve configured to close the at least one application nozzle. The valve comprises an inner member that is encompassed by the cap and is rotatably attached to the neck of the container and has a valve member configured to close the application nozzle. The cap is axially movable between a first closed position and a second open position by rotation of the cap.

14 Claims, 7 Drawing Sheets

Figure 1:
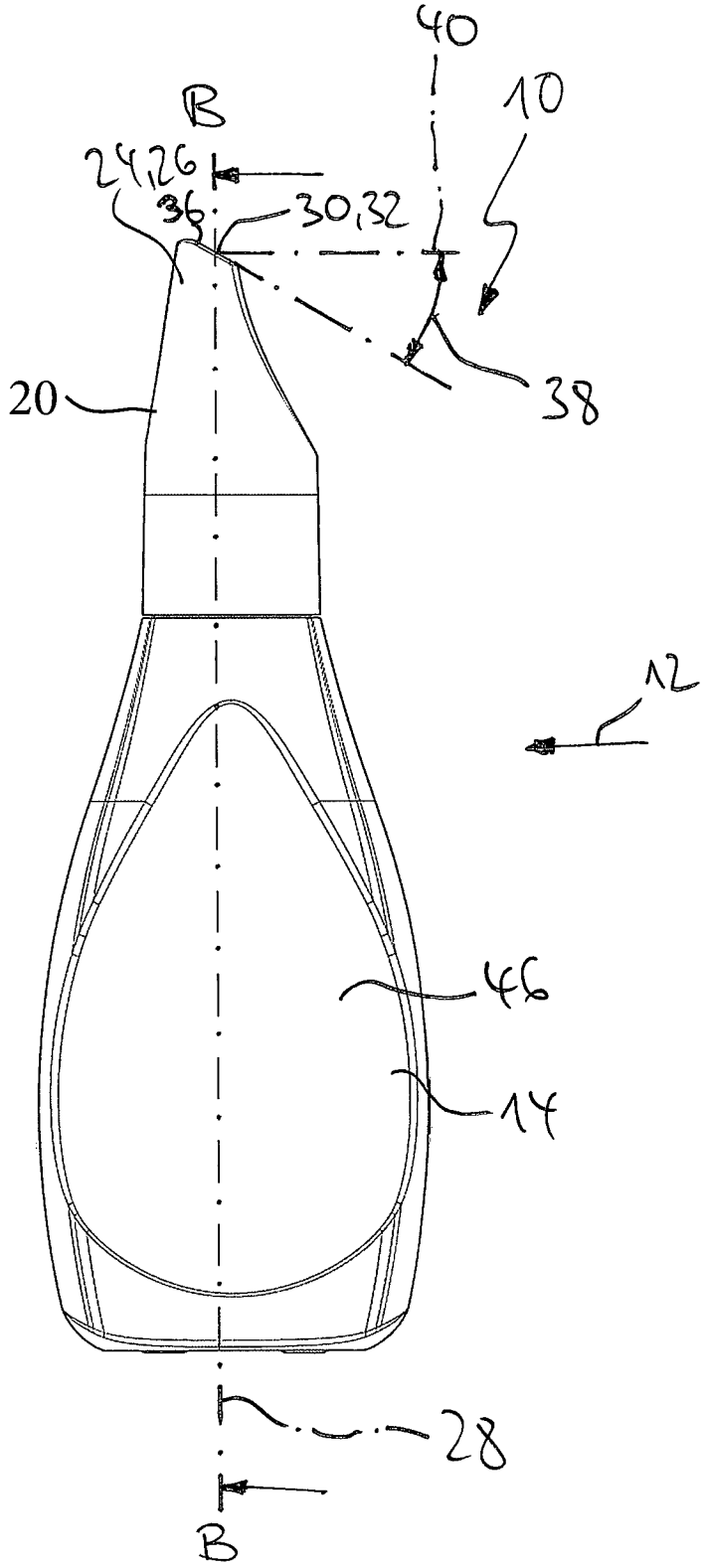

(58) Field of Classification Search
CPC ..... A45D 19/0075; A45D 19/0041; A45D 2019/0033; A45D 24/00; A45D 24/22; A45D 2200/05; A45D 34/00; A45D 40/26; B65D 37/00; B65D 51/1683; B65D 51/1644; B65D 51/1661; B65D 47/246; B65D 41/04; A61M 35/003
See application file for complete search history.

(56) References Cited

U.S. PATENT DOCUMENTS 2,771,890 A * 11/1956 Jaberg ..... A45D 24/24 132/115
3,366,284 A * 1/1968 Marona ..... G01F 11/082 222/215
4,461,408 A * 7/1984 Shepard ..... B65D 47/248 401/148
4,495,958 A * 1/1985 Roeder ..... A45D 34/04 401/207
4,617,949 A * 10/1986 Hofmann-Igl ..... A45D 34/04 425/522
7,000,618 B2 * 2/2006 Dovergne ..... A45D 24/22 132/112
7,168,433 B2 * 1/2007 De LaForcade ..... B65D 47/42 401/131
2002/0096184 A1 * 7/2002 Elmer ..... A45D 19/02 132/114
2013/0075430 A1 * 3/2013 Ragnarsson ..... B01F 25/20 222/206
2013/0094892 A1 4/2013 Spadaro
2014/0008389 A1 * 1/2014 Mekata ..... B65D 83/388 222/402.1
2018/0042354 A1 * 2/2018 Sugawara ..... A45D 19/012

OTHER PUBLICATIONS

International Preliminary Report on Patentability issued in International Application PCT/IB2017/000029 dated Dec. 12, 2018.

* cited by examiner

B - B

HAIR APPLICATOR

The invention relates to a hair applicator for the application of liquids, in particular of medical liquids, hair dye, hair-care products and/or skin care products for the scalp, the hair applicator comprising a container defining a volume for storing the liquids, in particular a bottle, the container having a neck, a cap configured to close the container at the neck and having at least one application tip with at least one application nozzle for the application of the liquids.

Such hair applicators are well known from the prior art. In general, hair applicators are used to apply different liquids to human hair or to the human scalp. For example, hair applicators are used in the hair dressing industry to apply hair dye or hair-care products. Moreover, hair applicators are used to apply medical liquids to the human scalp such as skin care products or other types of liquid medicine, for treatment of atopic dermatitis, hair loss etc.

Nevertheless, it is often times not possible to open the application nozzle for the application of the liquid and to efficiently close the application nozzle after the application of the liquid with the hair applicators known form the prior art. Especially in the medical field it is particularly desirable that the hair applicator can be closed reliably after the medical liquids have been applied to the human hair and/or human scalp, in order to avoid evaporation losses of contents.

On the other hand, hair applicators are known which can be closed reliably but which fail to provide an efficient way of applying the liquids to the human hair and/or human scalp. Moreover, hair applicators for the hairdressing industry have to be cheap in order to fulfil the economical requirements.

It is therefore an object of the subject invention to provide a cost efficient hair applicator that provides for an efficient application of liquids to the human hair and/or human scalp and for an easy and reliable way of opening and closing the application nozzle, and also to allow fast reflow of the fluid into the applicator while avoiding residual liquid and leaking in the area of the application nozzle after closing.

This object is solved by a hair applicator according to the features of claim 1. Such a hair applicator is characterized in that the hair applicator comprises a valve configured to close the at least one application nozzle, wherein the valve comprises a hollow cap and an inner member that is encompassed by the cap and rotatably attached to the neck of the container and that has a valve member configured to close the application nozzle, wherein the cap is connected to the neck of the container such that a rotational movement of the cap is translated into an axial movement of the application nozzle away from the container along a longitudinal axis of the hair applicator, and wherein the cap is axially movable between a first closed position and a second open position by rotation of the cap. Such a hair applicator is particularly advantageous because the application nozzle can be easily opened and closed by rotating the cap around the longitudinal axis and thereby moving the cap away from the inner member, which is rotatably attached to the neck of the container. By moving the cap away from the inner member, a conduit which connects the container with the application nozzle is opened. On the other hand, such a hair applicator provides for a secure closure of the container when the cap is moved back into the closed position. Preferably the at least one application nozzle is having a choke or throttle that is configured to allow liquid stored in the volume of the container to be released in the form of drops.

According to a first preferred embodiment of the hair applicator, the cap has a fork-like shape with the two legs extending axially, wherein each leg forms an application tip having an application nozzle. Such a fork-like shape has proven to be very efficient for the application of liquids to the human hair and/or human scalp because the legs of the cap can easily glide over the head of a person while human hair glides through the space which is defined by the two opposing legs.

According to another preferred embodiment of the hair applicator, the inner member has a fork-like shape, wherein the inner member comprises two legs extending axially and housed in the hollow legs of the cap, wherein the legs of the inner member have a free end facing away from the neck of the container, wherein the free ends of the legs of the inner member form the valve member. Such a form of the inner member is adapted to the form of the cap such that the two application nozzles arranged at the legs of the fork-like cap can be closed by the inner member when the cap is in the closed position.

Accordingly, it is particularly preferred if the legs of the cap are hollow and configured to house the respective legs of the inner member. In such a configuration, the inner member can be fully encompassed by the cap.

In order to provide for an efficient closure of the application nozzle it is particularly preferred if the cap in its interior comprises a valve seat configured to be closed by the valve member in the closed position. Preferably, the valve seat that is arranged in the interior of the leg of the cap at the free end of the leg has a shape that corresponds to a shape of the valve member.

It is furthermore preferred if the neck has a free end opposite to the container, wherein the neck has a ring shoulder at its free end that projects from the lateral surface of the neck. Preferably the ring shoulder projects radially inwardly or radially outwardly.

In order to rotatably attach the inner member to the neck of the container it is particularly preferred if the inner member has a circular recess configured for the insertion of the free end of the neck of the container, wherein the recess is arranged on the side of the inner member facing away from the valve member, wherein the inner member has a ring shoulder. Preferably this ring shoulder of the inner member projects radially outwardly or radially inwardly and corresponds with the ring shoulder of the neck of the container such that the inner member is rotatably attached but axially secured to the neck.

Accordingly, it is particularly preferred if the ring shoulder of the inner member corresponds with the ring shoulder of the neck. By such a configuration a pivot bearing can be realized between the neck of the container and the inner member.

According to another particularly preferred embodiment of the hair applicator the neck is circular cylindrical and comprises a thread on its lateral surface, wherein the cap comprises an internal thread that corresponds to the thread of the neck, wherein the pitch of the thread is configured such that the rotation of the cap moves the cap into the open position.

If is particularly preferred if the thread of the neck and the internal thread of the cap are configured such that a rotation of the cap by 90° moves the cap into the open position.

Preferably the neck comprises a stopper that is configured to limit rotational movement of the cap. According to a particularly preferred embodiment, at least one stopper is provided that is formed as a protrusion that extends radially from a lateral surface of the neck of the container, i.e.

perpendicular to the longitudinal axis of the hair applicator. In another preferred embodiment of the hair applicator, at least two stoppers are provided which are arranged on opposing sides of the neck of the container.

In order to efficiently apply liquids, in particular medical liquids, hair dye, hair-care products and/or skin care products to the hair or scalp, the application tip has an application surface that is inclined in an angle within the range of about 20° to 40°, preferably of about 30° with respect to a plane that is perpendicular to the longitudinal axis of the hair applicator. Such an inclination has proven to be ergonomic when the hair applicator is used headfirst, i.e. upside down.

According to another preferred embodiment of the hair applicator, the neck is formed in one piece with the container. Preferably, the neck and the container, i.e. the bottle is made by injection-molding.

According to a preferred embodiment of the hair applicator which facilitates the handling and use of the hair applicator, the container has a drop-shaped form with two opposing essentially flat handling surfaces. Such a hair applicator can be easily held in one hand wherein a pressing force can be exerted on the flat handling surfaces in order to push the liquid through the application nozzle.

Preferably the container is made of plastic, in particular of an elastic plastic, wherein the container is configured to be compressible.

Further details and advantages of the invention can be taken from the following description, on the basis of which the embodiments of the invention that are represented in the figures are described and explained in more detail.

Figure 2:
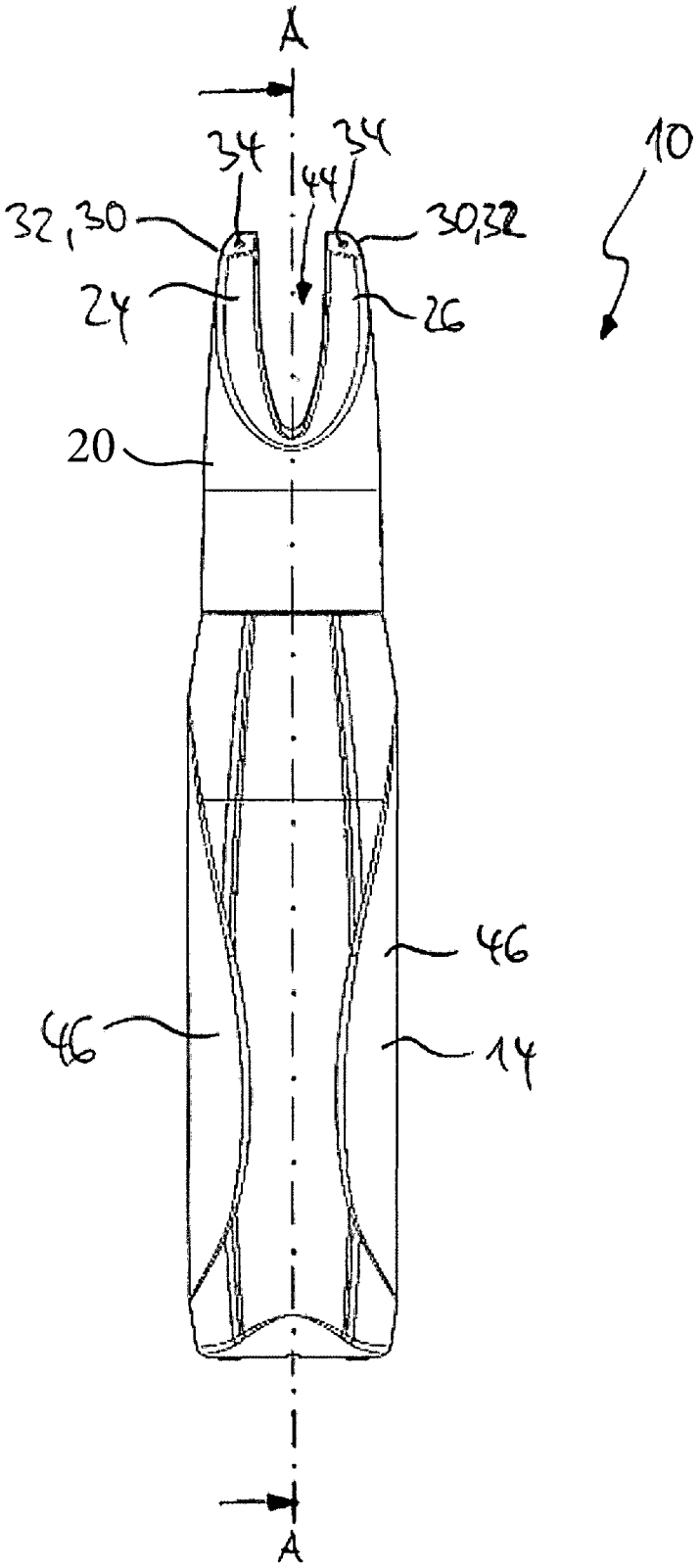
Figure 3:
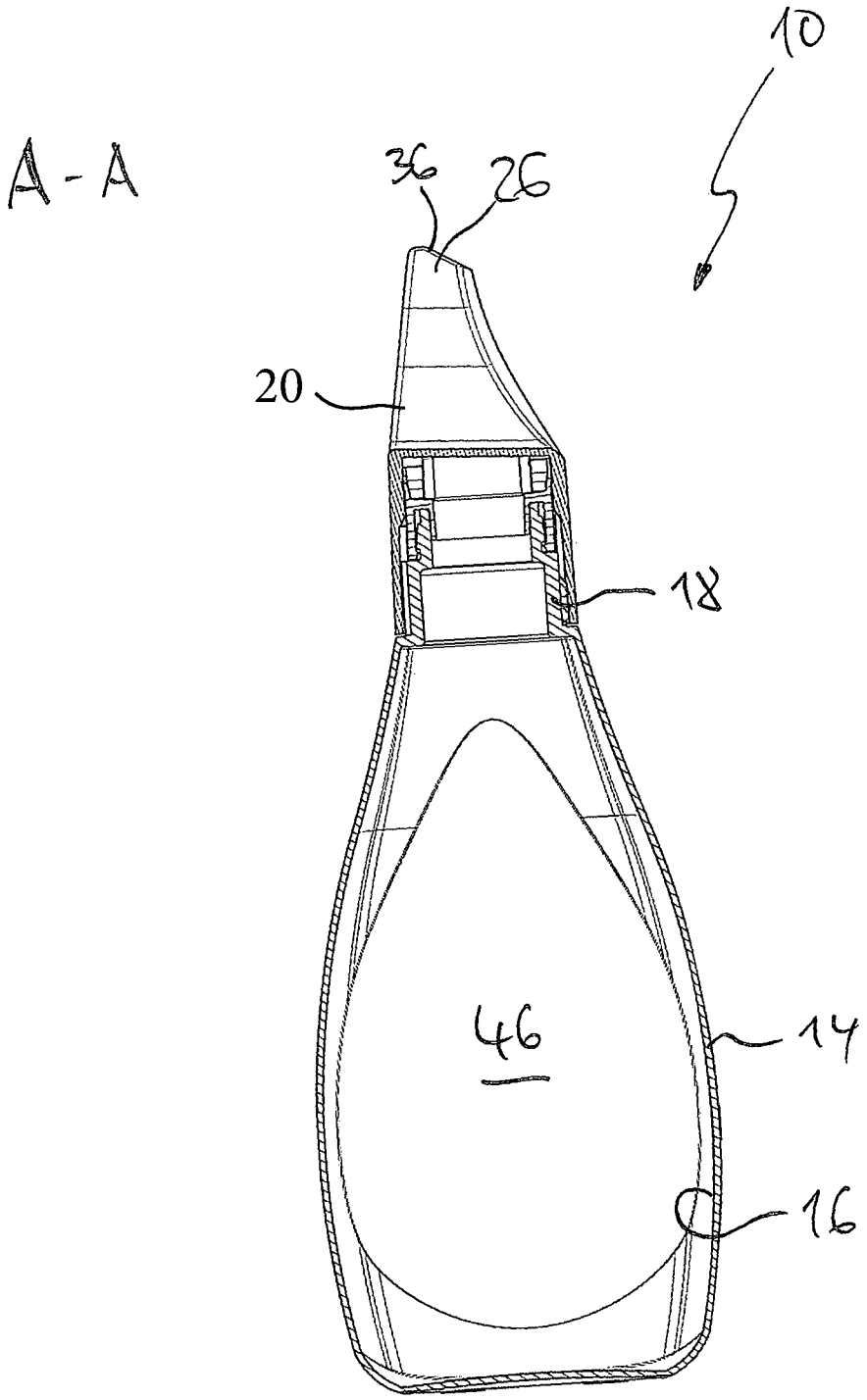
Figure 4:
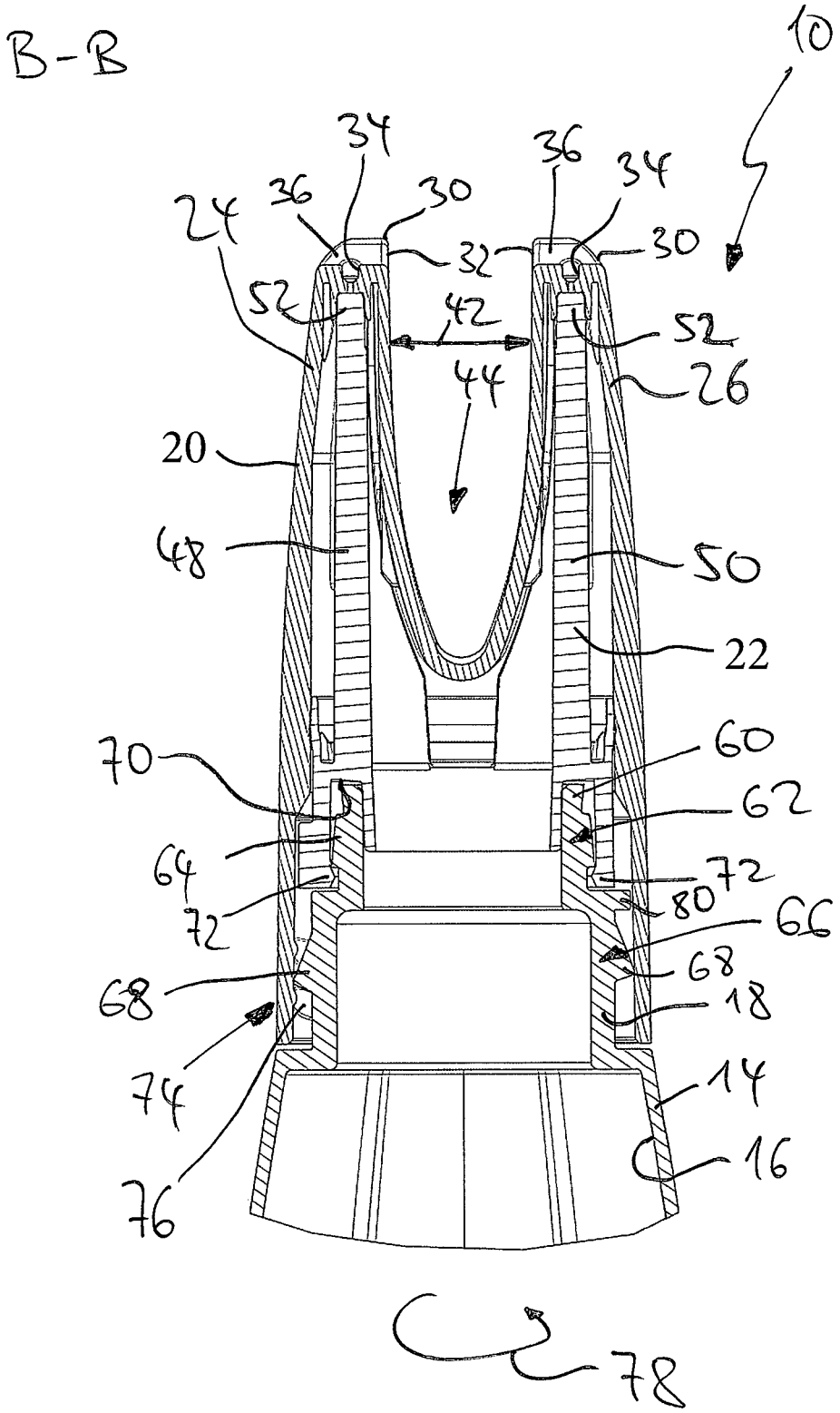
Figure 5:
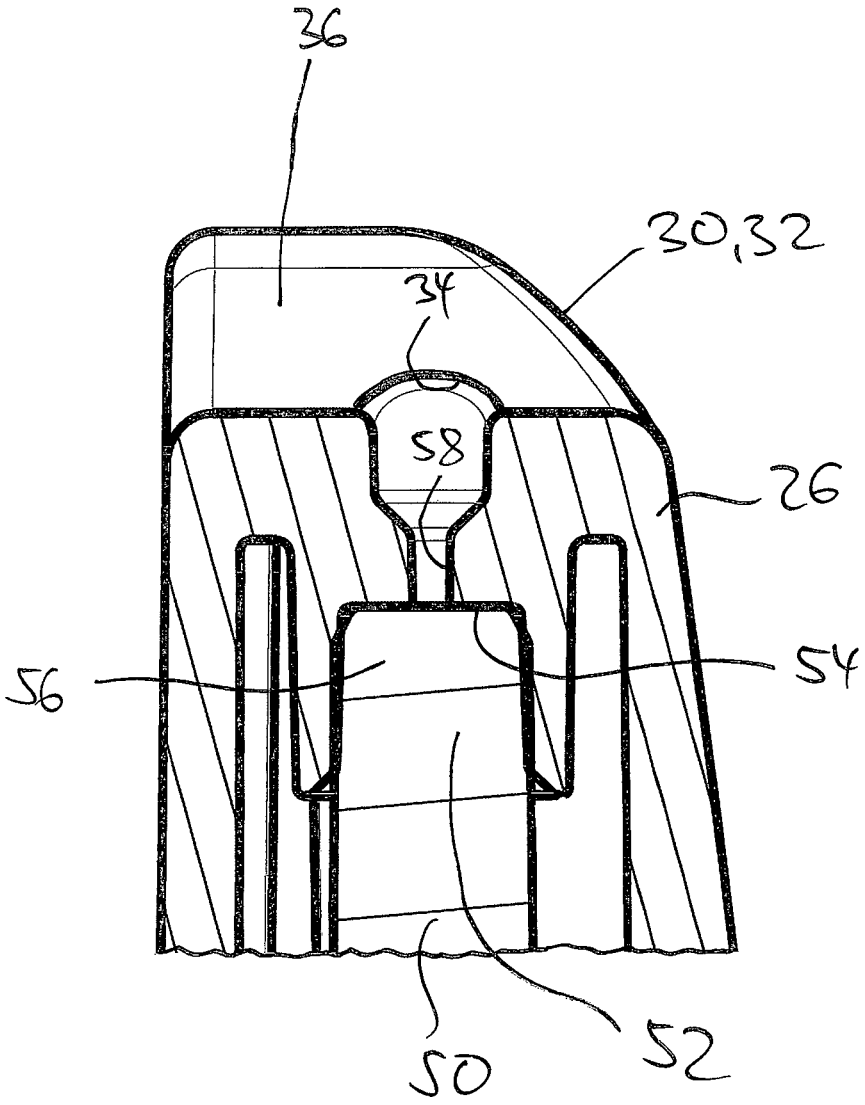
Figure 6:
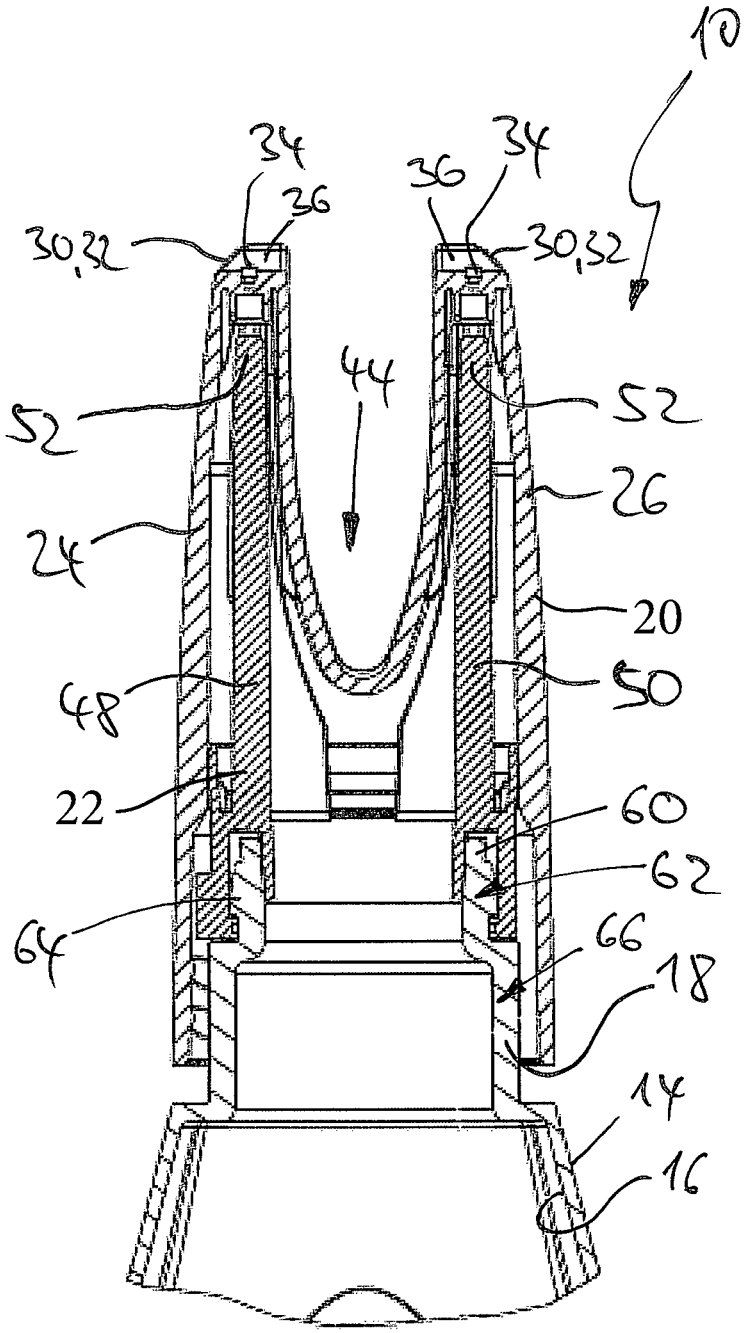
Figure 7:
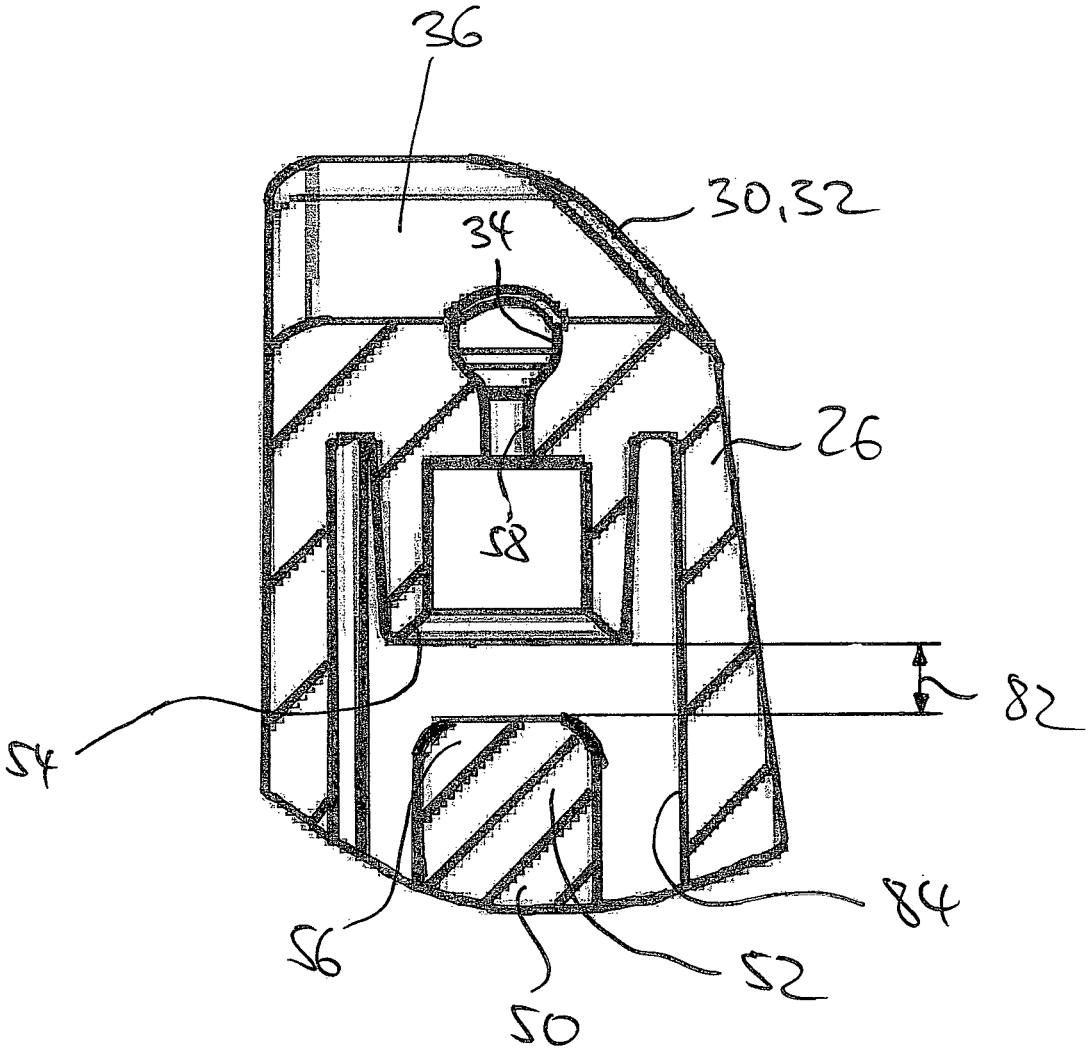

Respective figures are showing:

FIG. 1 a front side elevational view of a hair applicator according to the invention;

FIG. 2 a right side elevational view of the hair applicator of FIG. 1;

FIG. 3 a sectional view of the hair applicator of FIGS. 1 and 2 in a section along the line A-A in FIG. 2;

FIG. 4 a sectional view of the hair applicator of FIGS. 1 and 2 in a section along the line B-B in FIG. 1 in a closed position of the cap;

FIG. 5 a detail of the sectional view of FIG. 4;

FIG. 6 a sectional view of the hair applicator of FIGS. 1 and 2 in a section along the line B-B in FIG. 1 in an open position of the cap; and FIG. 7 a detail of the sectional view of FIG. 6.

FIGS. 1 to 7 show a hair applicator 10 according to an embodiment of the invention. FIG. 1 shows a front side elevational view of the hair applicator 10, wherein FIG. 2 shows a right side elevational view of the hair applicator 10 when looking into the direction of arrow 12 in FIG. 1.

FIG. 3 shows a sectional view of the hair applicator 10 in a section along the line A-A in FIG. 2. FIGS. 4 and 6 show respective sectional views of the hair applicator 10 in a section along the line B-B in FIG. 1 in a closed position (cf. FIG. 4) and in an open position (cf. FIG. 6). FIG. 5 shows a detail of the sectional view of FIG. 4, wherein FIG. 7 shows a detail of the sectional view of FIG. 6. In the drawing description corresponding parts and elements are denoted with the same reference numerals.

The hair applicator 10 is configured for the application of liquids, in particular for the application of medical liquids, hair dye, hair-care products and/or skin care products for the scalp. The hair applicator 10 comprises a container 14 configured as a bottle and defining a volume 16 for storing the liquids. The container 14 has a neck 18 (cf. FIGS. 3,4 and 6).

Moreover, the hair applicator 10 comprises a cap 20 configured to close the container 14 and an inner member 22 that is encompassed by the cap 20. The cap 20 has a fork-like shape with two legs 24, 26 extending axially, i.e. in the direction of a longitudinal axis 28 of the hair applicator 10. Each leg 24, 26 has a free end 30 facing away from the container 14, wherein the free end 30 of the legs 24, 26 forms an application tip 32 with an application nozzle 34. The application tip 32 has an application surface 36 that is inclined in an angle 38 within the range of about 20° to 40°, preferably of about 30° with respect to a plane 40 that is perpendicular to the longitudinal axis 28 of the hair applicator 10. The legs 24, 26 of the cap 20 are spaced apart in a distance 42 and define a space 44.

The container 14 which is formed in one piece with the neck 18, for example by injection-molding, and which is made from an elastic plastic, has a drop-shape with two opposing essentially flat handling surfaces 46. The container 14 is configured to be compressible, at least in the area of the handling surfaces 46.

The cap 20 is hollow and encompasses the inner member 22. The inner member 22 also has a fork-like shape corresponding to the shape of the cap 20 and comprises two legs 48, 50 which have a free end 52 facing away from the neck 18 of the container 14. The legs 48, 50 are housed in the hollow legs 24, 26 of the cap 20.

In the interior of the cap 20, in particular in the free end 30 of the hollow legs 24, 26, a valve seat 54 is provided. The free ends 52 of the legs 48, 50 form a valve member 56 that corresponds with the valve seat 54 to close the valve seat 54. The valve seat 54 has a conical shape (cf. FIG. 7) wherein the valve member 56 has a cylindrical shape with rounded edges. The valve seat 54 is connected to the application nozzle 34 via a through hole 58. The through hole 58 is configured as a throttle or choke which is configured to allow liquid stored in the volume 16 of the container 14 to be released in the form of drops. Accordingly, a valve is formed by the cap 20 and the inner member 22 that is configured to close the application nozzles 34 of the legs 24, 26.

At its free end 60 opposite to the container 14, the neck 18 of the container 14 comprises a first portion 62 that is substantially cylindrical and that comprises a ring shoulder 64 that projects radially outwardly. Moreover, the neck 18 has a second portion 66 that is arranged between the first portion 62 and the container 14. The second portion 66 of the neck 18 is also substantially circular cylindrical and comprises an outer thread 68 on its lateral surface.

The inner member r 22 has a circular recess 70 that is configured for the insertion of the free end 60 of the neck 18 of the container 14. This recess 70 is arranged on the side of the inner member 22 that faces away from the valve member 56. The inner member 22 also has a ring shoulder 72 that projects radially inwardly and that corresponds with the ring shoulder 64 of the first portion 62 of the neck 18 such that the inner member 22 is rotatably attached to the first portion 62 of the neck but axially fixed by the undercut between the ring shoulder 64 of the neck 18 and the ring shoulder 72 of the inner member 22.

The cap 20 also has a substantially cylindrical threaded portion 74 with an internal thread 76 that corresponds to the thread 68 of the second portion 66 of the neck 18. Accordingly, the cap 20 is connected to the neck 18 of the container 14 such that a rotational movement of the cap 20 is translated into an axial movement of the application nozzle 34 away from the container 14 along the longitudinal axis 28 of the hair applicator 10. The cap 20 is thereby movable between a first closed position (cf. FIGS. 4 and 5) and a second open position (cf. FIGS. 6 and 7).

The threads 68, 76 have a pitch that is configured such that a rotation of the cap in the direction of arrow 78 in FIG. 4 moves the cap 20 into the open position. In order to limit the rotational movement of the cap 20, the neck comprises a stopper 80 that is arranged between the first portion 62 and the second portion 66 of the neck 18 and that extends radially. This stopper 80 is configured to limit the rotational movement of the cap 20 and cooperates with a stopper 80 of the cap 20 which is not depicted in the drawings.

The thread 76 of the cap 20 and the thread 68 of the neck 18, as well as the stopper 80 are configured such that a rotation of the cap 20 by 90° in the direction of arrow 78 moves the cap into the open position depicted in FIGS. 6 and 7. In the open position the valve member 56 is spaced apart from the valve seat 54 in a distance 82 of about 2 mm (cf. FIG. 7).

The hair applicator 10 functions as follows:

The cap of a hair applicator 10 which is filled with a liquid, in particular a medical liquid, hair dye, hair-care product and/or skin care product for the scalp in the volume 16 of the container 14 is rotated by 90° into the direction of arrow 78 (cf. FIG. 4), thereby axially moving the cap 20 into the open position. In the open position, the valve member 56 is spaced apart from the valve seat 54, thereby providing a conduit 84 (cf. FIG. 7) for the liquid stored in the volume 16 of the container 14.

By pressing the handling surfaces 46 of the elastic container 14, the fluid can be pressed through the conduit 84 and the application nozzles 34 of the legs 24, 26 of the cap 20. When the hair applicator 10 is held upside down, the liquid can be applied to human hair or the human scalp via the application surfaces 36 of the legs 24, 26 of the cap 20. Depending on the pressure applied to the container 14 via the handling surfaces 46, the liquid will be released with more or less speed. After application of the liquid, the cap 20 can be rotated by 90° against the direction indicated by arrow 78 in FIG. 4, thereby moving the cap 20 into the closed position when the valve member 56 is fully inserted into the valve seat 54.

Therefore, a hair applicator 10 can be provided that facilitates the application of liquids to the human hair and/or human scalp and that provides for an easy and reliable way of opening and closing the application nozzle 34.

The invention claimed is:

1. A hair applicator for the application of liquids including medical liquids, hair dye, hair-care products, skin care products for the scalp, or combinations thereof, the hair applicator comprising:

a container defining a volume for storing the liquids, the container being a bottle, the container having a neck;

a hollow cap configured to close the container at the neck and having at least one application tip with at least one application nozzle for the application of the liquids, wherein the cap comprises hollow legs;

a valve configured to close the at least one application nozzle;

wherein the valve comprises the cap and an inner member that is encompassed by the cap and rotatably attached to the neck of the container, the inner member having a valve member configured to close the application nozzle;

wherein the cap is connected to the neck of the container such that a rotational movement of the cap is translated into an axial movement of the application nozzle away from the container along a longitudinal axis of the hair applicator;

wherein the cap is axially movable between a first closed position and a second open position by rotation of the cap; and wherein the inner member has a fork-like shape, wherein the inner member comprises two legs extending axially and housed in the hollow legs of the cap, wherein the legs of the inner member have a free end facing away from the neck of the container, wherein the free ends of the legs of the inner member form the valve member.

2. The hair applicator according to claim 1, wherein the cap has a fork-like shape with two legs extending axially, wherein each leg forms an application tip having an application nozzle.

3. The hair applicator according to claim 1, wherein the legs of the cap are hollow and configured to house the respective legs of the inner member.

4. The hair applicator according to claim 1, wherein the cap in its interior comprises a valve seat configured to be closed by the valve member in the closed position.

5. The hair applicator according to claim 1, wherein the neck has a free end opposite to the container, wherein the neck has a ring shoulder at its free end that projects from the lateral surface of the neck.

6. The hair applicator according to claim 1, wherein the inner member has a circular recess configured for the insertion of the free end of the neck of the container, wherein the recess is arranged on the side of the inner member facing away from the valve member, wherein the inner member has a ring shoulder.

7. The hair applicator according to claim 5, wherein the ring shoulder of the inner member corresponds with the ring shoulder of the neck.

8. The hair applicator according to claim 1, wherein the neck is cylindrical and comprises a thread on its lateral surface, wherein the cap comprises an internal thread that corresponds to the thread of the neck, wherein the pitch of the thread is configured such that the rotation of the cap moves the cap into the open position.

9. The hair applicator according to claim 8, wherein the thread of the neck and the internal thread of the cap are configured such that a rotation of the cap by 90° moves the cap into the open position.

10. The hair applicator according to claim 1, wherein the neck comprises a stopper that is configured to limit rotational movement of the cap.

11. The hair applicator according to claim 1, wherein the application tip has an application surface that is inclined in an angle within the range of 20° to 40° with respect to a plane that is perpendicular to the longitudinal axis of the hair applicator.

12. The hair applicator according to claim 1, wherein the neck is formed in one piece with the container.

13. The hair applicator according to claim 1, wherein the container has a drop-shaped form with two opposing, essentially flat, handling surfaces.

14. The hair applicator according to claim 1, wherein the container is made of an elastic plastic and wherein the container is configured to be compressible.

* * * * *